US006435913B1

(12) United States Patent
Billman

(10) Patent No.: US 6,435,913 B1
(45) Date of Patent: Aug. 20, 2002

(54) HEADER CONNECTOR HAVING TWO SHIELDS THEREIN

(75) Inventor: Timothy B. Billman, Dover, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/882,526

(22) Filed: Jun. 15, 2001

(51) Int. Cl.[7] ..... H01R 13/648
(52) U.S. Cl. ..... 439/608; 439/107
(58) Field of Search ..... 439/608, 101, 439/108

(56) References Cited

U.S. PATENT DOCUMENTS 4,869,677 A * 9/1989 Johnson et al. ..... 439/80
4,975,084 A * 12/1990 Fedder et al. ..... 439/608
5,620,340 A * 4/1997 Andrews ..... 439/108
5,980,321 A * 11/1999 Cohen et al. ..... 439/108
6,146,202 A * 11/2000 Ramey et al. ..... 439/608
6,231,391 B1 * 5/2001 Ramey et al. ..... 439/608

* cited by examiner

*Primary Examiner*—Gary F. Paumen
(74) *Attorney, Agent, or Firm*—Wei Te Chung

(57) ABSTRACT

A header connector (2) comprises an elongated body (4) having a base portion (12), a plurality of signal contact (6) received in the base portion, a first shield (8) and a second shield (10). Each contact comprises a middle portion (32) positioned in the base portion, a plurality of retaining portions (34) extending downwardly from the middle portion, and a plurality of engaging portions (36) extending upwardly from the middle portion. The first shield has a plurality of strips (2) located in the base portion of the body. The second shield has a plurality of beams. The first shield intersects with the second shield.

1 Claim, 7 Drawing Sheets

HEADER CONNECTOR HAVING TWO SHIELDS THEREIN

BACKGROUND OF THE INVENTION

1. Field of the Invention

The present invention relates to a header connector and particularly to a head connector having two groups of shields therein.

2. Description of Related Art

U.S. Pat. No. 4,869,677 discloses a backplane connector. The backplane connector includes a first connector element and a mating second connector element. Each connector element has a plurality of rows of signal contacts and a row of ground contacts. When the two elements are joined, the contacts directed upwardly between sidewalls of the first connector element are connected to a plurality of corresponding downwardly directed contacts of the second connector element, thereby providing a signal path and a ground path between the two connector elements.

However, continued advances in the design of electronic devices for data processing and communications systems, have placed rigorous demands on the design of electrical connector, particular to high speed and high density environment. However, an electrical connector in the prior art generally has one ground path in a direction. In this situation, the only one ground path when failed for some reasons would damage internal circuit of the electronic devices. Hence, an improved connector is required to overcome the disadvantages of the prior art.

SUMMARY OF THE INVENTION

Accordingly, the object of the present invention is to provide a header connector having two shields for providing a ground path without increasing the overall size of the header connector.

In order to achieve the object set forth, a header connector comprises an elongated body having a base portion, a plurality of signal contacts received in the base portion, and a plurality of shielding strips and a plurality of shielding beams. The base portion has a plurality of passageways and through-holes therein. Each contact comprises a middle portion positioned in the through-hole, a plurality of retaining portions extending downwardly from the middle portion, and a plurality of engaging portions extending upwardly from the middle portion. The plurality of strips and beams are located in the passageways of the base portion for shielding the signal contacts. Each of the beams and the strips defines a middle portion, and the middle portion of each beam defines a plurality of gaps for receiving corresponding middle portions of the strips. The strips are arranged parallel to each other in a first direction. The beams are arranged parallel to each other in a second direction which is perpendicular to the first direction.

Other objects, advantages and novel features of the invention will become more apparent from the following detailed description when taken in conjunction with the accompanying drawings.

DETAILED DESCRIPTION OF THE INVENTION

Figure 1:
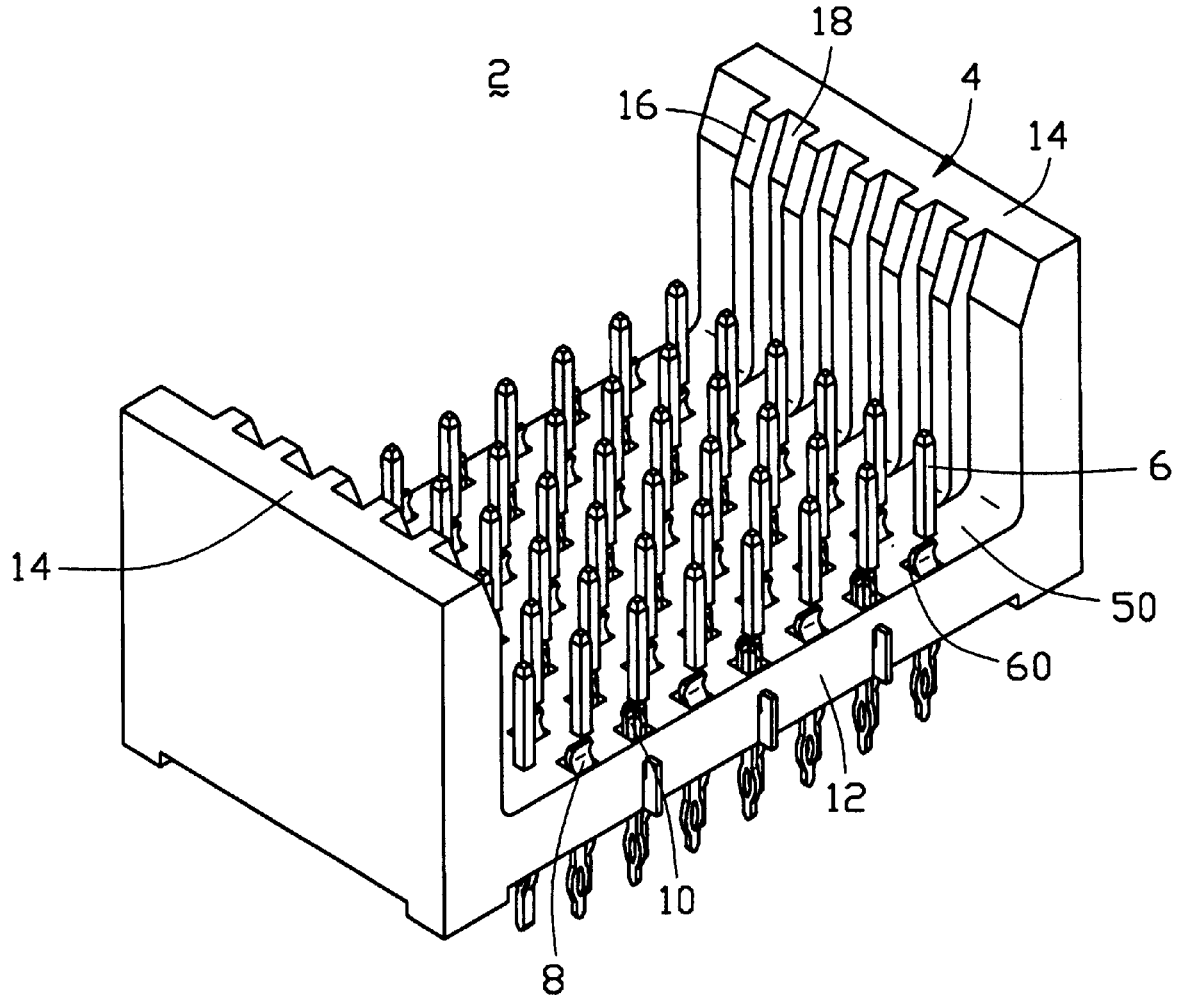
FIG. 1 is a perspective view of a header connector in accordance with the present invention.

Reference will now be made to the drawing figures to describe the present invention in detail.

Referring to FIG. 1, a header connector 2 of the present invention comprises an elongated body 4, a plurality of signal terminals 6 received in the body 4, and a first shield 8 and a second shield 10. The body 4 includes a base portion 12 and two sidewalls 14 extending upwardly from the base portion 12. A plurality of baffles 16 project from inner wall of the sidewalls 14, thereby defining several grooves 18 between every two abutting baffles 16 for leading the insertion of a complementary connector (not shown).

Figure 2:
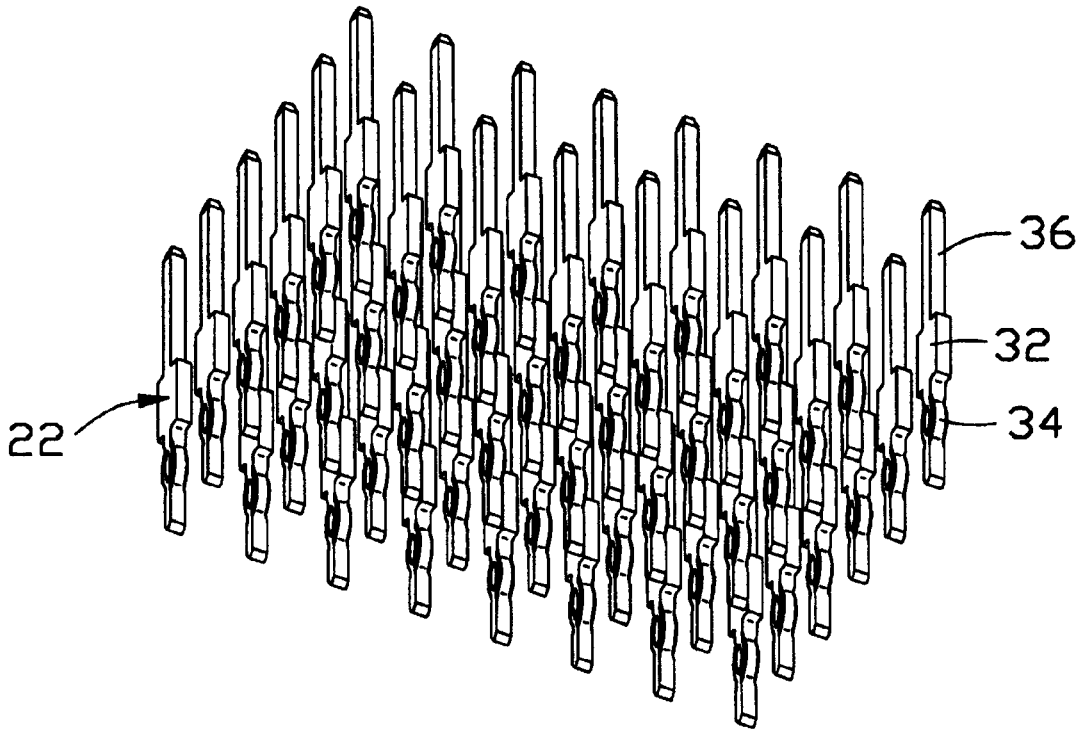
FIG. 2 is a perspective view of terminals in accordance with the present invention.
Figure 3:
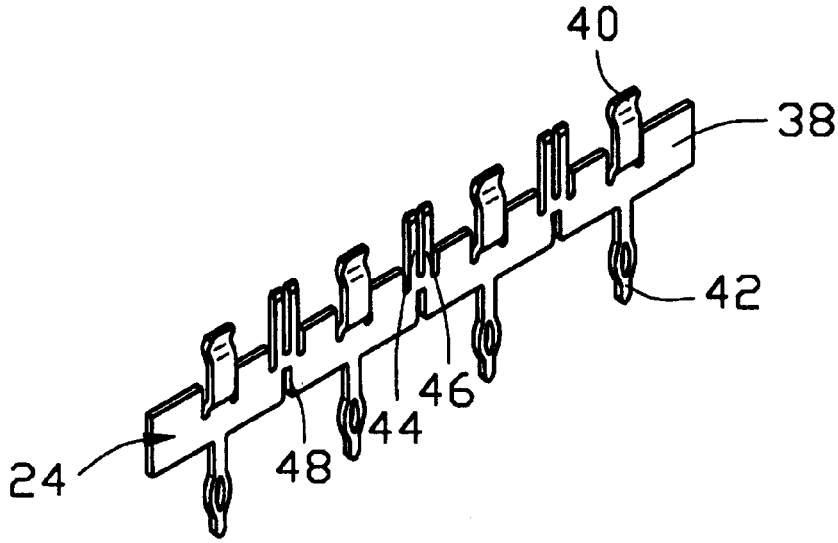
FIG. 3 is a perspective view of a second shield in accordance with the present invention.
Figure 4:
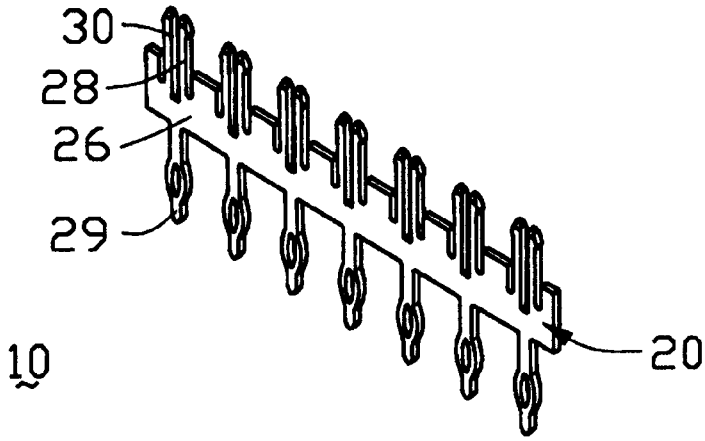
FIG. 4 is a perspective view of a first shield in accordance with the present invention.

Referring to FIGS. 2–4, in the embodiment illustrated, the terminals 6 are arranged in six rows each having eight individual contacts 22. The first shield 8 has three strips 20, and the second shield 10 consists of seven beams 24. Each contact 22 includes a middle portion 32, an engaging section 36 and a retaining section 34 respectively extending upwardly and downwardly from the middle portion 32. Each strip 20 has a middle portion 26, seven pairs of first arms 28 and seven retaining sections 29 respectively extending upwardly and downwardly from the middle portion 26. Each pair of first arms 28 defines a first slot 30 therebetween. Each beam 24 includes a middle portion 38, four ribs and four retaining sections 42 respectively extending upwardly and downwardly from the middle portion 26, wherein the ribs 40 are offset from the middle portion 38. Between every two abutting ribs 40, there is a pair of second arms 44. Similar to the first arms 28, a second slot 46 is defined between each pair of second arms 44. In addition, a gap 48 is defined in the middle portion 38 below the second slot 46 corresponding to the second slot 48. Furthermore, all retaining sections 29, 34 and 42 have press-fit structure for retaining.

Figure 5:
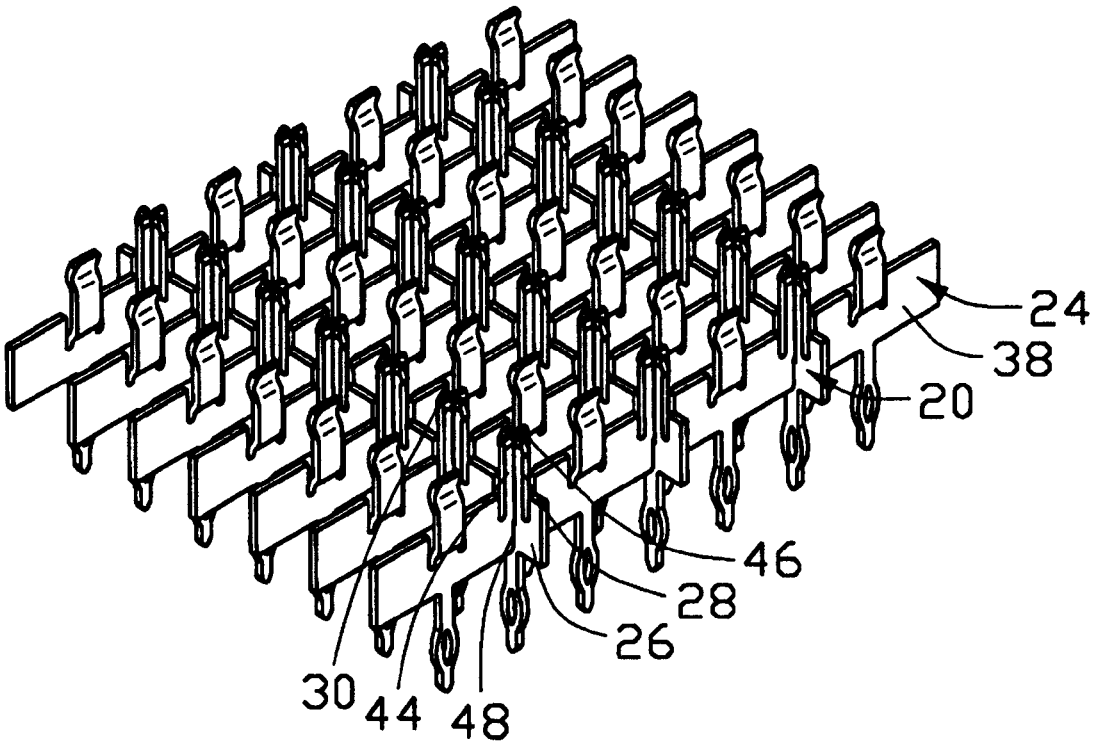
FIG. 5 is an assembled perspective view of the first and second shields.

Referring to FIG. 5, when assembling the first shield 8 and the second shield 10, the steps are as follows. Firstly, disposing the strips 20 perpendicular to the beams 24; secondly, aligning the middle portion 26 of each strip 20 with multiple corresponding gaps 48 of the second shield 10, and aligning the first slots 30 with the corresponding middle portions 28 of the second shield 10; subsequently, inserting the middle portion 26 into the gaps 48 for making the middle portions 38 receive in the first slot 30, and finally making each pair first arms 28 and corresponding pair second arms 44 crossing each other, wherein the first slot 30 intersects with the corresponding second slot 46.

Figure 6:
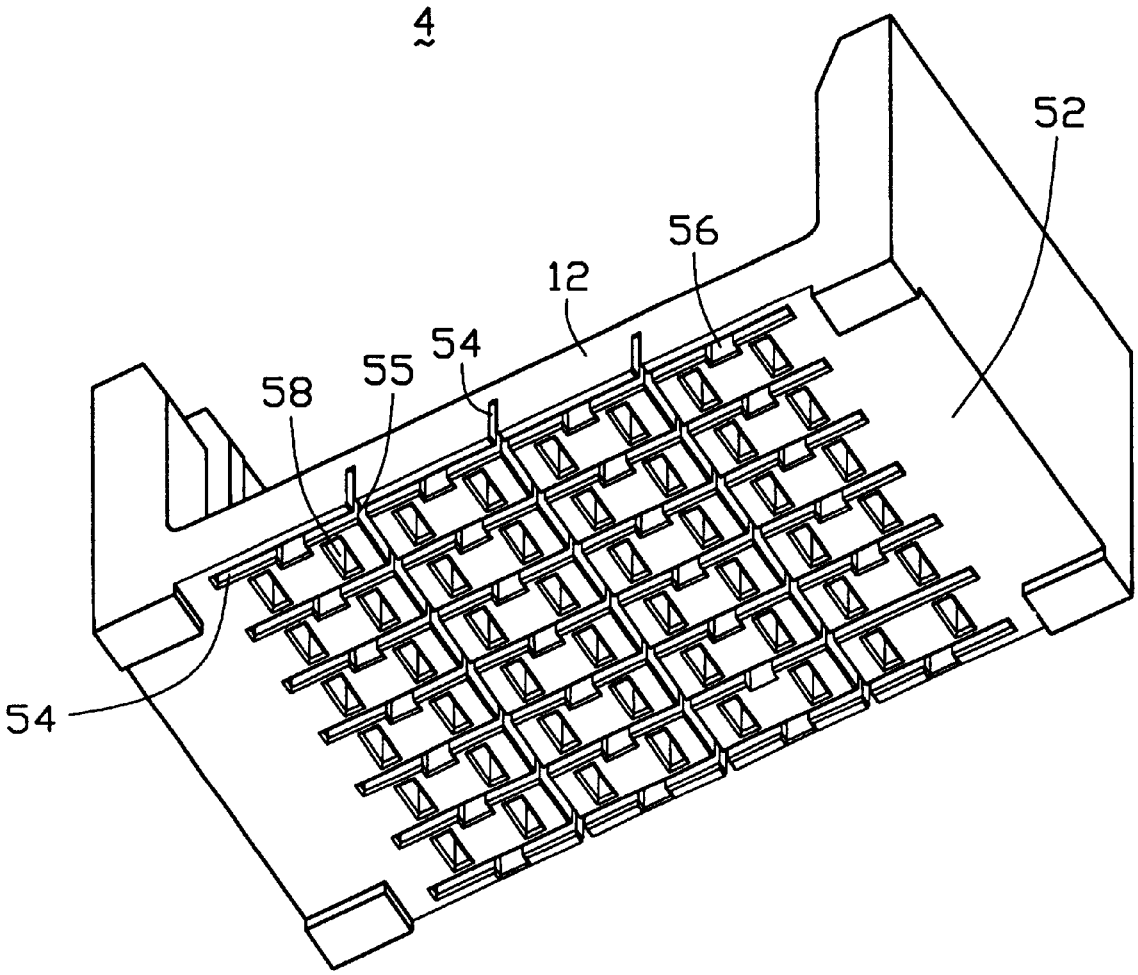
FIG. 6 is a perspective view of a body in accordance with the present invention.
Figure 7:
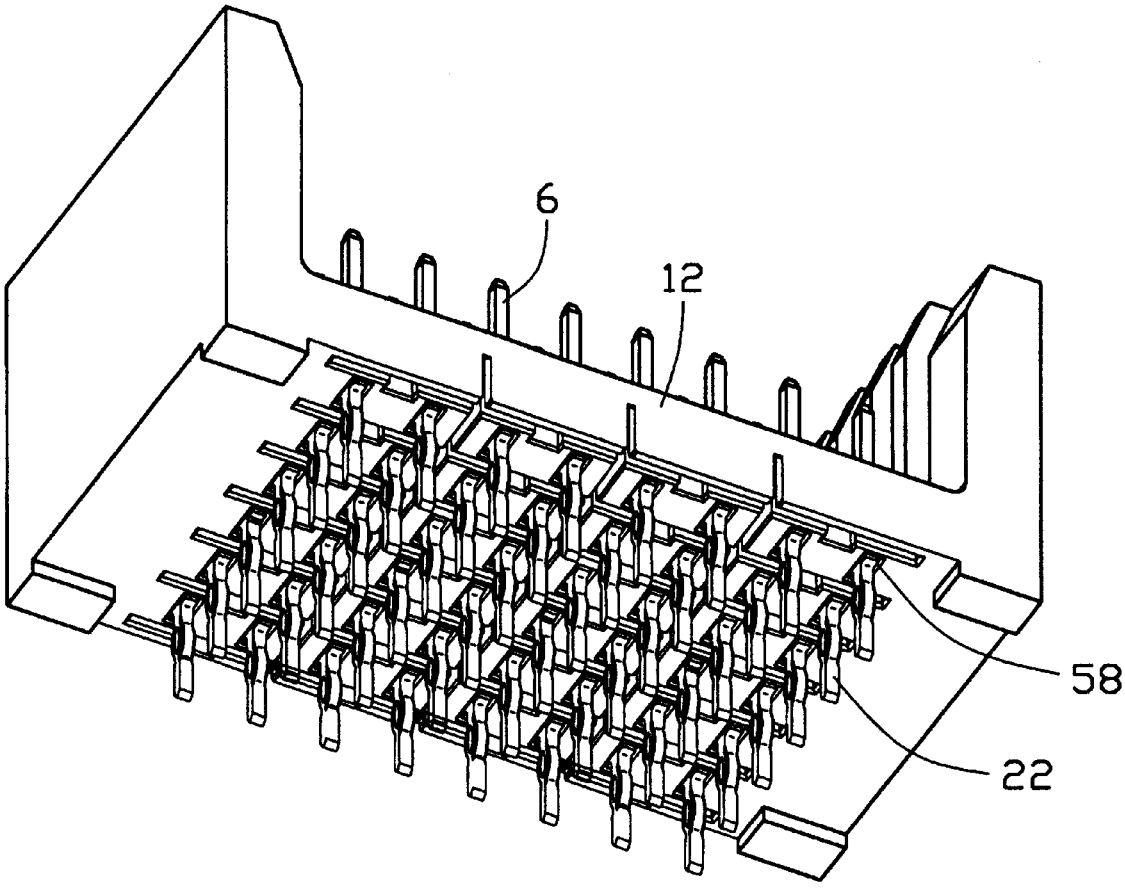
FIG. 7 is another perspective view of the body with the terminals of FIG. 6.

Referring to FIGS. 1 and 6, the base portion 12 defines an upper surface 50 and a bottom surface 52. The body 4 has a plurality of passageways 54 from the bottom surface 52 for receiving the first shield 8 and the second shield 10. The passageways 54 are arranged in two directions which are parallel to or perpendicular to a lengthwise direction of the body 4, thereby defining a plurality of apertures 55 at the intersections. Four recesses 56 are disposed at same side of each passageway 54 which is parallel to the elongated direction for extension of the ribs 40. The base portion 12 further defines an array of through-holes 58 for extensions of the contacts 22 (see FIG. 7), wherein each recess 56 is disposed between two neighboring through-holes 58. In addition, the base portion 12 defines a plurality of openings 60 from the upper surface 50. The openings 60 are in communication with the recesses 56 and the apertures 55 for extensions of the ribs 40, the first arms 28 and second arms 44, respectively.

Figure 8:
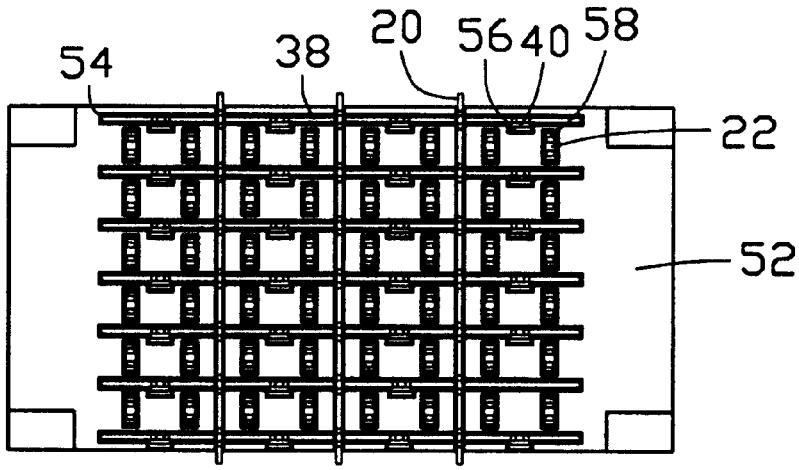
FIG. 8 is a bottom view of the head connector.
Figure 9:
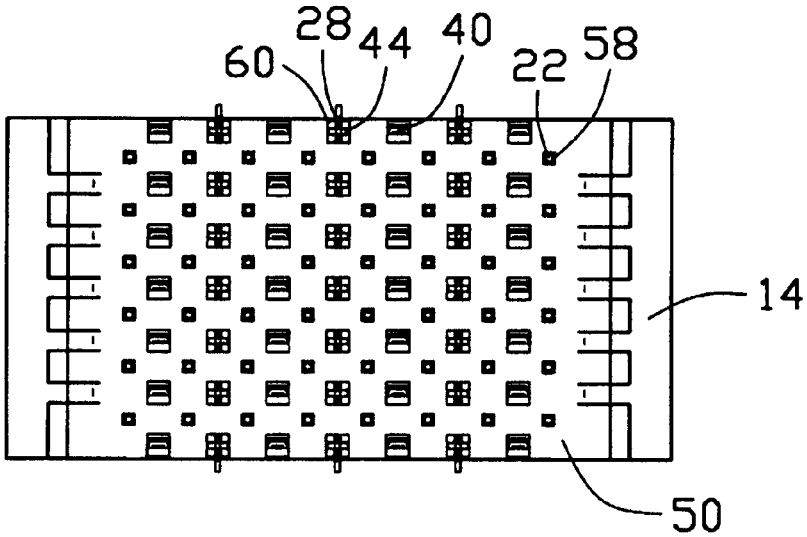
FIG. 9 is a top view of the header connector.

In assembly, referring to FIGS. 1, 8 and 9, the first shield 8 and the second shield 10 intersect with each other, and then the first shield 8 and the second shield 10 and the terminals 6 are inserted into the base portion 12. The contacts 22 are received in the through-holes 58, the strips 20 of the first shield 8 and the middle portions 38 of the second shield 10 are received in passageways 54, the ribs 40 extend through and are located upon the recesses 56, and the first and second arms 28, 44 extend through and are positioned upon the apertures 55. Furthermore, both ends of the strips 20 extend outside of base portion 12, which allow the strips 20 to engage contacting features located in the grounding structure of the complementary connector.

In addition, the height, where the contact 22 is distanced from the upper surface 50 of the base portion 12is higher than that of the first shield 8 and the second shield 10 thereby making the contacts 22 firstly contact with the complementary connector during mating. Both the first shield 8 and the second shield 10 provide the ground paths for the header connector 2 thereby ensuring high-speed data transmission.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A header connector comprising:

an elongated body having a base portion, the base portion having a plurality of passageways and through-holes therein;

a plurality of signal contacts received in the base portion, each contact comprising a middle portion positioned in a corresponding through-hole, a retaining portion extending downwardly from the middle portion, and an engaging portion extending upwardly from the middle portion; and a plurality of shielding strips and a plurality of shielding beams being located in the passageways of the base portion for shielding the signal contacts, each of the beams and the strips defining a middle portion, the middle portion of each beam defining a plurality of gaps for receiving corresponding middle portions of the strips said strips being arranged parallel to each other in a first direction, said beams being arranged parallel to each other in a second direction which is perpendicular to the first direction;

wherein each strip includes several pairs of first arms and several retaining sections respectively extending upwardly and downwardly from the middle portion thereof;

wherein each beam includes several ribs and several retaining sections respectively extending upwardly and downwardly from the middle portion thereof;

wherein each of the ribs is curved;

wherein the beam further comprises a plurality of pairs of second arms;

wherein at least some of the signal contacts are surrounded by two ribs, two pairs of first arms and two pairs of second arms;

wherein the rest of the signal contacts are surrounded by two ribs;

wherein each pair of first arms and each pair of second arms respectively define a slot therebetween, the slots of the first arms intersecting with the slots of the second arms;

wherein the base portion defines a plurality of openings for extension of the ribs and the first arms and the second arms, each opening being aligned with an intersection of the strips and the beams;

wherein each opening is in communication with a corresponding passageway;

wherein retaining section of the strips and the beams has a press-fit structure for retaining in a printed circuit board;

further comprising two sidewalls extending upwardly from both ends of the base portion;

wherein a plurality of baffles project from an inner wall of the sidewall, every two baffles defining a groove therebetween.

* * * * *